US011833439B2

(12) United States Patent
Wei et al.

(10) Patent No.: US 11,833,439 B2
(45) Date of Patent: Dec. 5, 2023

(54) MAGNETIC CONDUCTIVE CAR MODEL

(71) Applicant: Shenzhen Doohan Industrial Co., Ltd., Shenzhen (CN)

(72) Inventors: Houneng Wei, Shenzhen (CN); Jia Luo, Shenzhen (CN)

(73) Assignee: SHENZHEN DOOHAN INDUSTRIAL CO., LTD., Shenzhen (CN)

( * ) Notice: Subject to any disclaimer, the term of this patent is extended or adjusted under 35 U.S.C. 154(b) by 122 days.

(21) Appl. No.: 17/489,685

(22) Filed: Sep. 29, 2021

(65) Prior Publication Data

US 2022/0016538 A1 Jan. 20, 2022

Related U.S. Application Data

(63) Continuation of application No. PCT/CN2019/098124, filed on Jul. 29, 2019.

(51) Int. Cl.

| | |
|---|---|
| ***A63H 17/26*** | (2006.01) |
| ***A63H 17/28*** | (2006.01) |
| ***A63H 17/30*** | (2006.01) |

(52) U.S. Cl.

CPC ..... *A63H 17/264* (2013.01); *A63H 17/28* (2013.01); *A63H 17/30* (2013.01)

(58) Field of Classification Search

CPC ..... A63H 17/002; A63H 17/28; A63H 17/30; A63H 17/264

See application file for complete search history.

(56) References Cited

U.S. PATENT DOCUMENTS

| | | | | |
|---|---|---|---|---|
| 6,364,509 | B1 * | 4/2002 | Johnson, III | A63H 17/32 446/175 |
| 6,773,321 | B1 * | 8/2004 | Urquiaga | A63H 17/28 446/457 |
| 7,100,968 | B2 * | 9/2006 | Mataja | B62K 9/00 446/470 |

(Continued)

FOREIGN PATENT DOCUMENTS

| | | | |
|---|---|---|---|
| CN | 201656126 | U | 11/2010 |
| CN | 106207610 | A | 12/2016 |

(Continued)

OTHER PUBLICATIONS

Translation KR200442475Y1 (Year: 2008).*
Written Opinion of the International Searching Authority.
International Search Report for PCT/CN2019/098124.

*Primary Examiner* — Eugene L Kim
*Assistant Examiner* — Alyssa M Hylinski

(57) ABSTRACT

A magnetic conductive car model includes a frame, a wheel positioned below the frame, a shell magnetically connected with the frame, a power supply arranged on the frame and a power consumption component positioned on the shell, when the frame is magnetically connected with the shell, the power supply is electrically connected with the power consumption component. The present disclosure can not only quickly and conveniently separate and assemble the shell and the frame, but also quickly and conveniently connect or disconnect a circuit between the shell and the frame, which is very convenient for maintenance and installation and improves use experiences of users.

12 Claims, 12 Drawing Sheets

(56) References Cited

U.S. PATENT DOCUMENTS

| | | | | |
|---|---|---|---|---|
| 7,568,962 | B2 * | 8/2009 | Amadio | A63H 17/002 446/470 |
| 7,717,767 | B2 * | 5/2010 | Amadio | A63H 17/262 446/427 |
| 8,992,285 | B1 * | 3/2015 | Frantz | A63H 17/002 446/469 |
| 9,861,906 | B1 * | 1/2018 | Calvert | A63H 33/086 |
| 9,980,405 | B2 * | 5/2018 | Hu | A63H 33/046 |
| 10,376,804 | B2 * | 8/2019 | Lu | F21V 23/001 |
| 2008/0254707 | A1 * | 10/2008 | Amadio | A63H 17/002 446/93 |
| 2012/0322343 | A1 * | 12/2012 | Fogarty | A63H 33/26 446/485 |
| 2019/0054388 | A1 * | 2/2019 | Cranias | A63H 33/26 |

FOREIGN PATENT DOCUMENTS

| | | | | |
|---|---|---|---|---|
| CN | 206777859 | U | 12/2017 | |
| CN | 207801078 | U | 8/2018 | |
| KR | 200442475 | Y1 * | 11/2008 | |
| WO | WO-2004035166 | A2 * | 4/2004 | A63H 17/002 |

* cited by examiner

MAGNETIC CONDUCTIVE CAR MODEL

CROSS-REFERENCE TO RELATED APPLICATION

The present application is a continuation-in-part-application of International Application PCT/CN2019/098124, with an international filing date of Jul. 29, 2019, the contents of all of which are hereby incorporated by reference.

BACKGROUND

1. Technical Field

The present disclosure generally relates to the technical field of car model toys, and especially relates to a magnetic conductive car model.

2. Description of Related Art

A car model is a model that is made in a strict proportion according to a shape, a structure, a color and even interior parts of a real car. Because of a real reproduction of main features of an original car and an excellent workmanship, the car model has a high value.

The car model generally includes a shell equipped with power consumption components such as lamps, and a frame equipped with power supply components such as batteries.

The shell and the frame in the conventional related art are fixedly connected with each other through screws and other connectors, and a large number of wires are connected between the shell and the frame for connecting circuits of the lamps and the batteries. Even if the screws between the shell and the frame are removed during maintenance, the wires are still connected between the shell and the frame, so that the shell can't be completely separated from the frame, resulting in inconveniently maintaining and installing the frame and the shell, to affect use experiences of users.

Therefore, the conventional car model needs to be developed to overcome the problems above mentioned.

SUMMARY

The technical problems to be solved: in view of the shortcomings of the related art, the present disclosure provides a magnetic conductive car model which can not only quickly and conveniently separate and assemble the shell and the frame, but also quickly and conveniently connect or disconnect circuits between the shell and the frame, which is very conveniently maintaining and installing the car model and improves use experiences of users.

The technical solution adopted for solving technical problems of the present disclosure is:

a magnetic conductive car model according to an embodiment of the present disclosure includes a frame including a first magnetic member arranged thereon; a plurality of wheels positioned below the frame; a shell covering on the frame and including a second magnetic member arranged thereon; a power supply arranged on the frame and electrically connected with the first magnetic member; a power consumption component arranged on the shell and electrically connected with the second magnetic member; and wherein the first magnetic member and the second magnetic member are attracted to each other to magnetically fix the frame with the shell, and electrically connect the power supply and the power consumption component; and wherein a pair of first mounting brackets is spaced on an upper end of the frame along a front and rear direction of the frame, and respectively installed with the first magnetic member thereon; a pair of second mounting brackets arranged on an inner surface of the shell opposite to the pair of first mounting brackets, and respectively installed with the second magnetic member thereon; and wherein the power supply includes a battery positioned on the frame, and the power consumption component includes a plurality of lamps positioned on the shell; and wherein the plurality of lamps includes a plurality of lamp-emitting diodes connected in parallel; and wherein the plurality of lamp-emitting diodes includes a roof lamp, a pair of headlamps, a right-turn lamp, a left-turn lamp, and a pair of back lamps connected in parallel; the first magnetic member including a first magnet, a second magnet, a third magnet, a fourth magnet and a fifth magnet; the second magnetic member including a sixth magnet, a seventh magnet, an eighth magnet, a ninth magnet and a tenth magnet; and wherein when the frame and the shell are magnetically attached with each other, the first magnet is connected between a first connecting portion and the sixth magnet, the second magnet connected between a second connecting portion and the seventh magnet, the third magnet connected between a third connecting portion and the eighth magnet, the fourth magnet connected between a fourth connecting portion and the ninth magnet, the fifth magnet connected between a fifth connecting portion and the tenth magnet; and anodes of the roof lamp, the pair of headlamps, the right-turn lamp, the left-turn lamp, and the pair of back lamps communally connected with the sixth magnet, cathodes of the pair of back lamps connected with the seventh magnet, a cathode of the left-turn lamp connected with the eighth magnet, a cathode of the right-turn lamp connected with the ninth magnet, and cathodes of the roof lamp, the pair of head lamps respectively connected with the tenth magnet.

Wherein a plurality of magnets arranged at intervals on each of the first magnetic member and the second magnetic member, each magnet connected with a wire and including a mounting hole formed on a middle thereof; a plurality of screw holes arranged at intervals on each of the pair of first mounting brackets and the pair of second mounting brackets; and wherein a screw passes through a respective mounting hole of a respective magnet and through a respective screw hole of the first and second mounting brackets to fix the magnets to the first and second mounting brackets.

Wherein the shell includes a plurality of plug holes, a plurality of posts arranged on the pair of second mounting brackets, to correspondingly insert into the plurality of plug holes of the shell.

Wherein each of the pair of first mounting brackets is a portal-frame configuration so that the first magnetic member is positioned on upper portions of the pair of first mounting brackets.

Wherein the car model includes a main control circuit set on the frame, the main control circuit including a plurality of wiring pins electrically connected with the first, second, third, fourth and fifth connecting portions, respectively, and a pair of power pins electrically connected with positive and negative poles of the battery, respectively.

Wherein a first resistance is connected between the anode of the roof lamp and the sixth magnet, a second resistance connected between one of the pair of head lamps and the sixth magnet, a third resistance connected between the other of the pair of head lamps and the sixth magnet, a fourth resistance connected between the anode of the right-turn lamp and the sixth magnet, a fifth resistance connected between the anode of the left-turn lamp and the sixth magnet, a sixth resistance connected between one of the pair of back lamps and the sixth magnet, a seventh resistance connected between the other of the pair of back lamps and the sixth magnet.

Wherein the car model further includes a drive member arranged on the frame.

Wherein a front axle and a rear axle are respectively arranged on a front end and a rear end of the frame, a fixing plate arranged on the middle of the frame, and a plurality of ball joint connecting rods respectively connected between the fixing plate, and the front axle and the rear axle.

Wherein the plurality of ball joint connecting rods includes a plurality of upper ball joint connecting rods, and a plurality of lower ball joint connecting rods arranged below the plurality of upper ball joint connecting rods.

Wherein the plurality of upper ball joint connecting rods is cross arranged with the plurality of lower ball joint connecting rods.

Wherein the car model further includes a plurality of damping mechanisms with a pair of damping mechanisms being connected between the frame and the front axle, and a pair of damping mechanisms being connected between the frame and the rear axle.

Wherein the car model further includes a remote control circuit unit received in the frame.

The present disclosure provides the first and second magnetic members between the shell and the frame to fix the frame and the shell, after the frame is connected with the shell by the magnetic attraction, circuits between the power supply that is arranged on the frame and the power consumption component that is arranged on the shell can be conducted, so that the frame and the shell can be installed and disassembled conveniently and quickly, and form electrical conduction between the circuits at the same time. During disassembly, the frame and the shell can be completely separated from each other, and the circuits can be connected at the same time during installation, which is convenient for the installation and maintenance of the car model, rather than being disturbed by the wires connected between the frame and the shell, and improves use experiences of users.

BRIEF DESCRIPTION OF THE DRAWINGS

In order to more clearly understand the technical solution hereinafter in embodiments of the present disclosure, a brief description to the drawings used in detailed description of embodiments hereinafter is provided thereof. Obviously, the drawings described below are some embodiments of the present disclosure, for one of ordinary skill in the related art, other drawings can be obtained according to the drawings below on the premise of no creative work.

Figure 1:
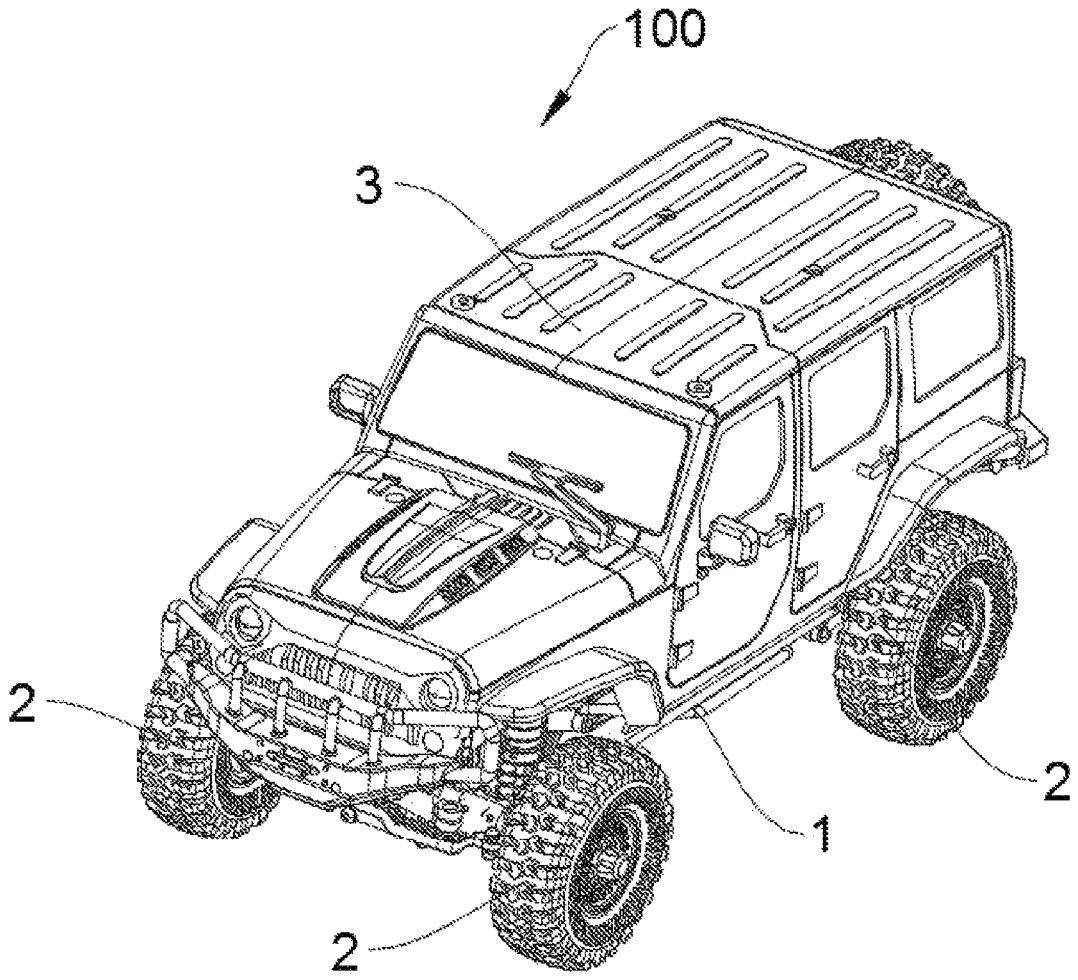
FIG. 1 is a schematic view of a magnetic conductive car model in accordance with an embodiment of the present disclosure.

The element labels according to the embodiment of the present disclosure shown as below:

magnetic conductive car model 100, frame 1, wheel 2, shell 3, power supply 4, power consumption component, lamp 5, first magnetic member 6, second magnetic member 7, wire 8, first mounting bracket 9, second mounting bracket 10, post 101, magnet 11, mounting hole 111, screw hole 12, screw 13, plug hole 14, drive member 15, remote control circuit unit 16, front axle 17, rear axle 18, fixing plate 19, connecting rod 20, spherical joint 201, hydraulic damping member 21, roof lamp D1, head lamp D2, D3, right-turn lamp D4, left-turn lamp D5, back lamp D6, D7, first magnet YA1, second magnet YA2, third magnet YA3, fourth magnet YA4, fifth magnet YA5, sixth magnet YA6, seventh magnet YA7, eighth magnet YA8, ninth magnet YA9, tenth magnet YA10, first connecting portion M1, second connecting portion M2, third connecting portion M3, fourth connecting portion M4, fifth connecting portion M5, first resistance R1, second resistance R2, third resistance R3, fourth resistance R4, fifth resistance R5, sixth resistance R6, seventh resistance R7.

DETAILED DESCRIPTION

Reference will now be made in detail to embodiments, examples of which are illustrated in the accompanying drawings. In the following detailed description, numerous specific details are set forth in order to provide a thorough understanding of the subject matter presented herein. Obviously, the implementation embodiment in the description is a part of the present disclosure implementation examples, rather than the implementation of all embodiments, examples. According to the described embodiment of the present disclosure, all other embodiments obtained by one of ordinary skill in the related art on the premise of no creative work are within the protection scope of the present disclosure.

In the description of the present disclosure, it needs to be explained that all the directional indicators (such as the terms: "upper", "below", "left", "right", "front", "back" . . . ), are shown in the specification of the present disclosure. The indicated orientation or position of the terms shown in the detailed description is based on the orientation or position shown in the figures of the accompanying drawings of the present disclosure, which is only to easily simplify the description of the present disclosure, but not indicated that the devices or elements of the present disclosure should have a particular orientation or should be designed and operated in a particular orientation. So the terms illustrated in the detail description are not by way of the limitation of the present disclosure.

In the description of the present disclosure, except where specifically otherwise illustrated or limited, the terms "connect" and "link" used herein should be understood in a broad sense. Such as, the meaning may be tight connection, removable connection, or integrated connection. The meaning may also be mechanical connection, electrical connection, direct connection or indirect connection through intermediaries, or internal connection within two elements. The meaning of the terms used herein may be understood by one of ordinary skill in the related art according to specific conditions of the present disclosure.

Furthermore, in the description of the present disclosure, the terms such as "first" and "second" shown in the specification are only used to describe, but not indicated that the elements of the present disclosure is important or represented the amount of the elements. That is, the features limited by the terms of "first" and "second" may explicitly or implicitly include one or more features.

Referring to FIGS. 1-4, a magnetic conductive car model 100 in accordance with an embodiment of the present disclosure includes a frame 1, a plurality of wheels 2 positioned below the frame 1, a shell 3 covered on the frame 1, a power supply 4 and a power consumption component 5 respectively arranged on the frame 1 and the shell 3. The power supply 4 is installed separately from the power consumption component 5, that is, when the power supply 4 is installed on the shell 3, the power consumption component 5 is installed on the frame 1; while, when the power supply 4 is installed on the frame 1, the power consumption component 5 is installed on the shell 3. Various components can also be installed on the frame 1, such as a chassis, a suspension damping system, a gearbox, a differential mechanism, an engine or a motor, and a power supply, etc.

In an embodiment of the present disclosure, the power supply 4 includes a battery 41 positioned on the frame 1, and the power consumption component 5 includes a plurality of lamps 51 positioned on the shell 3. The plurality of lamps 51 includes a plurality of roof lamps arranged on a front end of the shell 3, and a plurality of back lamps arranged on a rear end of the shell 3. It can be understood that the power supply 4 can also use supply power by an external power supply, and the frame 1 only needs to install an electrical connection connector connected to the external power supply.

As a possible implementation, the power supply 4 is positioned on the frame 1 and the power consumption component 5 is positioned on the shell 3.

A first magnetic member 6 is arranged on the frame 1 and electrically connected to the power supply 4.

A second magnetic member 7 is arranged on the shell 3 and electrically connected to the power consumption component 5.

The first magnetic member 6 and the second magnetic member 7 are attracted to each other to magnetically fix the frame 1 with the shell 3, and electrically connect the power supply 4 and the power consumption component 5.

Figure 4:
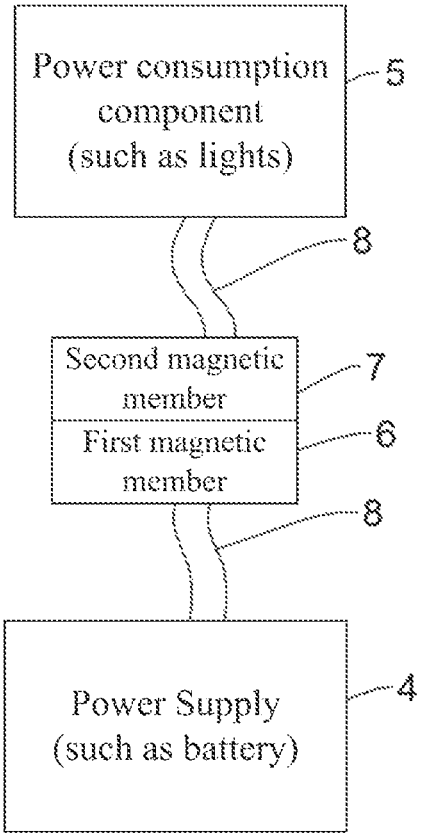
FIG. 4 is a circuit diagram of a first magnetic member, a second magnetic member, a power supply and a power consumption component of the magnetic conductive car model of FIG. 1.

The first magnetic member 6 and the frame 1 are insulated with each other, and the second magnetic member 7 and the shell 3 are insulated with each other. In the embodiment, when installing the frame 1 and the shell 3, the first magnetic member 6 is contacted and sucked with the second magnetic member 7. As shown in FIG. 4, the first magnetic member 6 is electrically connected to the power supply 4 by wires 8, and the second magnetic member 7 is electrically connected to the power consumption component 5 by wires 8, in this way, when the first magnetic member 6 is engaged with the second magnetic member 7, due to their respective conductive function of the first magnetic member 6 and the second magnetic member 7, and circuit connections between the power supply 4 and the power consumption component 5 is turned on, so as to ensure that the power consumption component 5 of the shell 3, such as the lamp 51, can be used normally. During disassembly the frame 1 and the shell 3, an outer force is applied to the shell 3 and the frame 1 to separate the first magnetic member 6 from the second magnetic member 7, so as to completely separate the frame 1 and the shell 3. In the separation state, no wires are connected between the frame 1 and the shell 3, which is not disturbed by wiring connections.

In the present disclosure, not only the frame 1 and the shell 3 are mechanically connected with each other, but also the power supply 4 and the power consumption component 5 are electrically connected with each other, through magnetically connecting the first magnetic member 6 and the second magnetic member 7. In this way, the magnetic conductive car model 100 of the present disclosure provides that the frame 1 and the shell 3 are fixed with each other via the magnetic connection therebetween, not only to prevent the shell 3 from separating from the frame 1, but also to ensure to normally use electrical components on the shell 3 after the frame 1 is magnetically connected with the shell 3. Therefore, the frame 1 and the shell 3 can be easily and quickly installed and disassembled. During disassembly, the frame 1 and the shell 3 can be completely separated from each other; during installation, circuits between the frame 1 and the shell 3 can be turned on at the same time, which is convenient for installing and maintaining the magnetic conductive car model 100, avoids defects of inconvenient disassembly and installation and interference by the wires connected between the frame 1 and the shell 3 in the prior art, and greatly improves use experiences of users.

Figure 5:
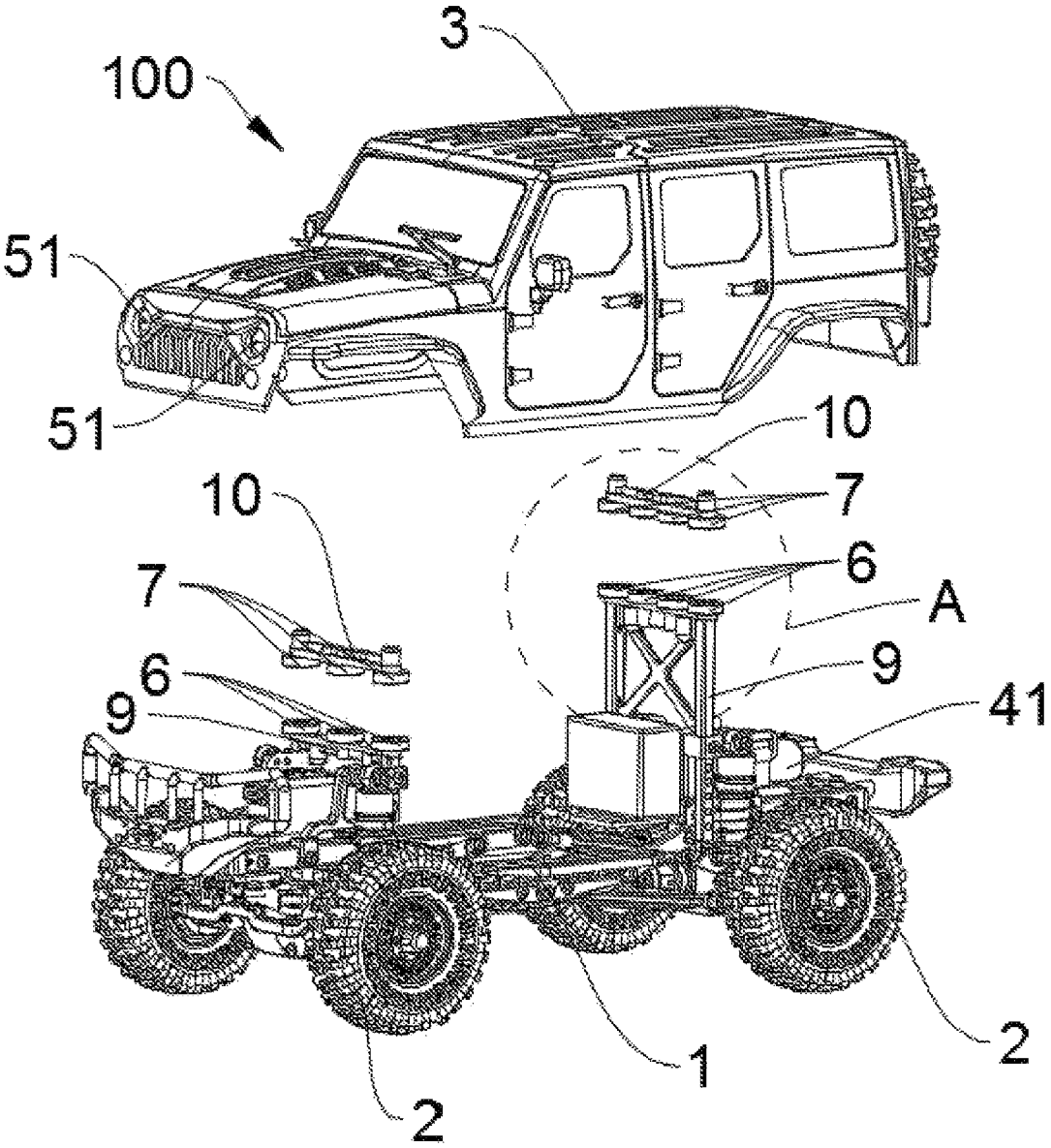
FIG. 5 is a schematic, exploded view of the magnetic conductive car model of FIG. 1, but not shown wires thereof.

Referring to FIG. 5, a pair of first mounting brackets 9 is spaced on an upper end of the frame 1 along a front and rear direction of the frame 1, and respectively installed with the first magnetic member 6 thereon.

A pair of second mounting brackets 10 is arranged on an inner surface of the shell 3 opposite to the pair of first mounting brackets 9, and respectively installed with the second magnetic member 7 thereon.

The first magnetic member 6 and the second magnetic member 7 are respectively arranged at the front and rear positions of the frame 1 and the shell 3 for forming magnetic connections therebetween, so as to further stably fixing the frame 1 with the shell 3.

Furthermore, the first mounting bracket 9 is a portal-frame configuration so that the first magnetic member 6 is positioned on the upper of the first mounting bracket 9. The first mounting bracket 9 is arranged as the portal-frame configuration, so that a space is formed between the first mounting bracket 9 and the frame 1, which is to conveniently install other parts on the frame 1.

Figure 6:
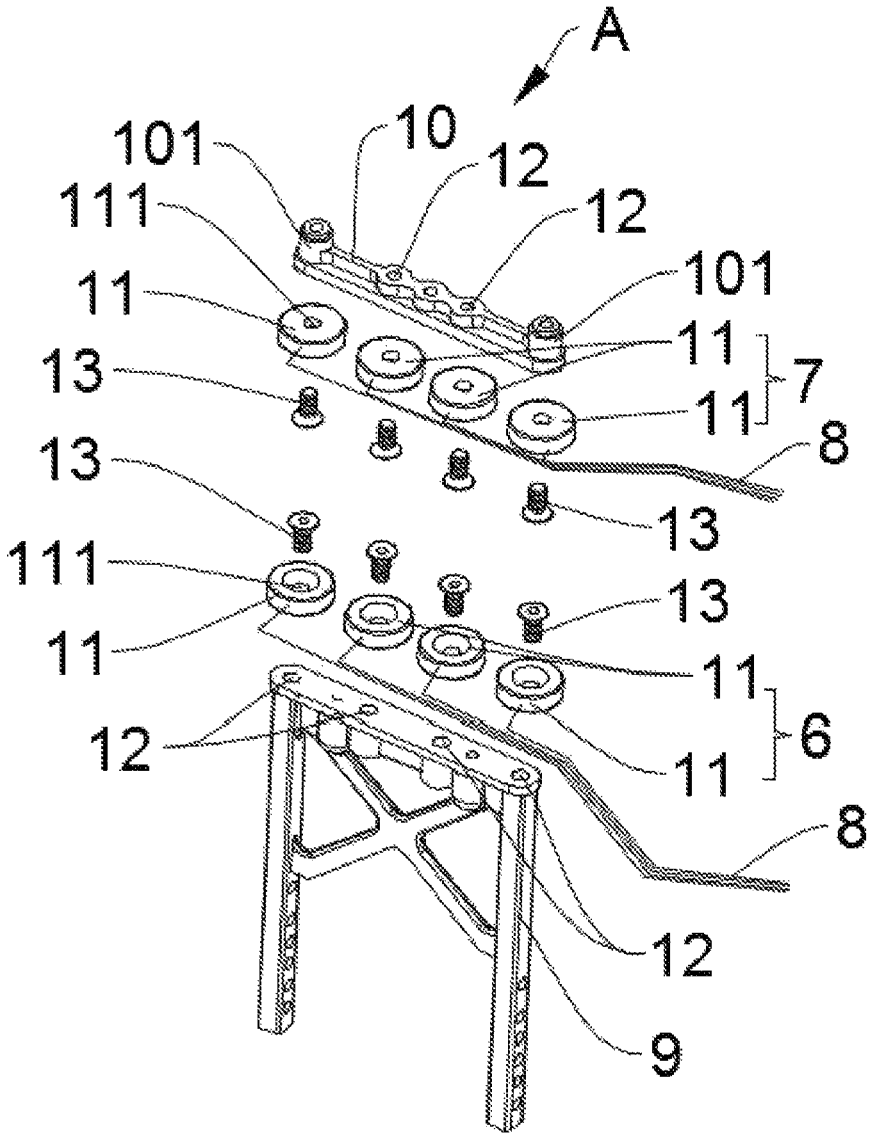
FIG. 6 is an enlarged schematic view of part A of FIG. 5.

Referring to FIG. 6, a plurality of magnets 11 is arranged at intervals on each of the first magnetic member 6 and the second magnetic member 7, each magnet 11 including a mounting hole 111 formed on a middle thereof, and connected with a wire 8. In an embodiment of the present disclosure, the magnet 11 and the wire 8 are welded together. The wire 8 that is connected with the magnet 11 is further connected with the power supply 4 or the power consumption component 5 accordingly, for example, the wires 8 that are connected with the plurality of magnets 11 arranged on the first magnetic member 6 are further connected with the power supply 4, and the wires 8 that are connected with the plurality of magnets 11 arranged on the second magnetic member 7 are further connected with the power consumption component 5. Each magnet 11 arranged on the first magnetic member 6 and the second magnetic member 7 can weld the wire 8 or several of the plurality of magnets 11 can weld the wire 8, as long as to form a conductive circuit therebetween.

A plurality of screw holes 12 is arranged at intervals on each of the pair of first mounting brackets 9 and the pair of second mounting brackets 10; a screw 13 passing through the respective mounting hole 111 to fix the respective magnet 11 to the respective screw hole 12 of the first and second mounting brackets 9, 10 accordingly. The plurality of magnets 11 is arranged on each of the first magnetic member 6 and the second magnetic member 7, so that the frame 1 can be magnetically fixed with the shell 3, firmly.

Figure 7:
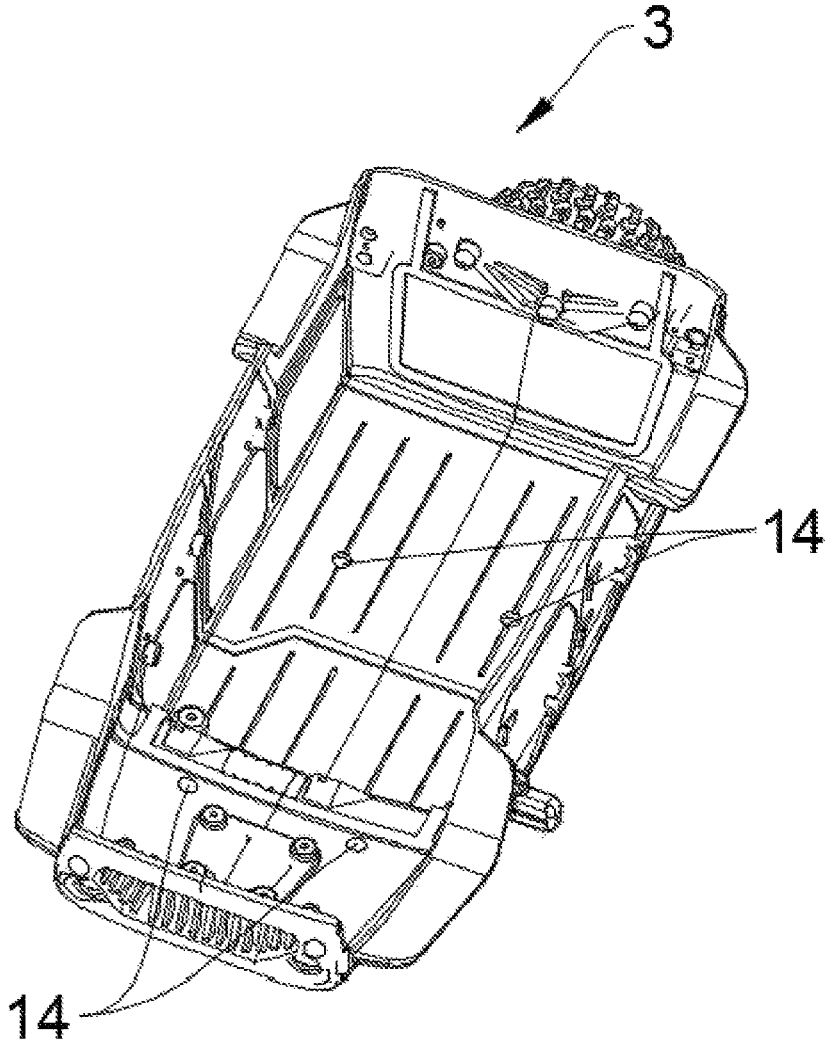
FIG. 7 is a bottom schematic view of a shell of the magnetic conductive car model of FIG. 1.

Referring to FIG. 7, the shell 3 includes a plurality of plug holes 14, a plurality of posts 101 arranged on the pair of second mounting brackets 10, to insert into the plurality of plug holes 14 of the shell 3, so that the pair of second mounting brackets 10 can be conveniently installed on the frame 1.

Optionally, the post 101 includes two ends symmetrically arranged thereon, so that the two ends of the pair of second magnetic mounting brackets 10 can be plugged into the shell 3 to enhance connections therebetween.

The plurality of lamps 51 positioned on the shell 3, includes a plurality of lamp-emitting diodes connected in parallel.

Figure 8:
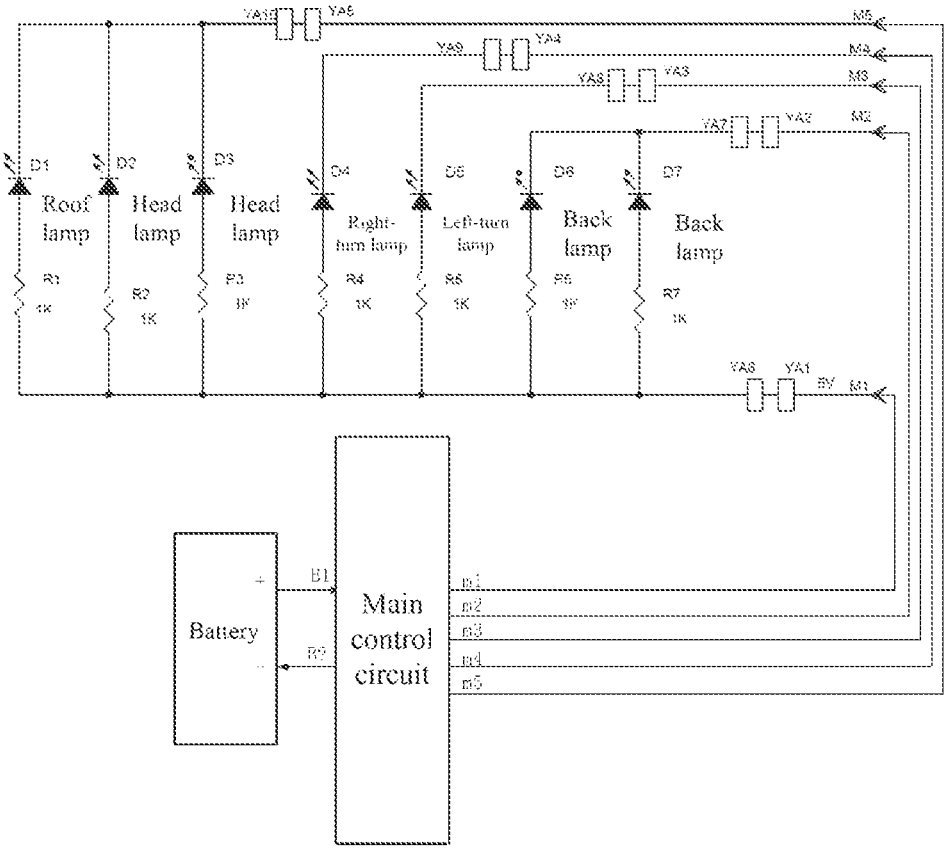
FIG. 8 is a circuit diagram of a plurality of lamps of the magnetic conductive car model of FIG. 1.

Specifically, referring to FIG. 8, the plurality of lamp-emitting diodes includes a roof lamp D1, a pair of headlamps D2, D3, a right-turn lamp D4, a left-turn lamp D5, and a pair of back lamps D6, D7 connected in parallel.

The first magnetic member 6 includes a first magnet YA1, a second magnet YA2, a third magnet YA3, a fourth magnet YA4 and a fifth magnet YA5; and the second magnetic member 7 includes a sixth magnet YA6, a seventh magnet YA7, an eighth magnet YA8, a ninth magnet YA9 and a tenth magnet YA10.

The first magnet YA1 is connected between a first connecting portion M1 and the sixth magnet YA6, the second magnet YA2 connected between a second connecting portion M2 and the seventh magnet YA7, the third magnet YA3 connected between a third connecting portion M3 and the eighth magnet YA8, the fourth magnet YA4 connected between a fourth connecting portion M4 and the ninth magnet YA9, the fifth magnet connected YA5 between a fifth connecting portion M5 and the tenth magnet YA10. The fifth connecting portion M5 is connected with the battery 41.

Anodes of the roof lamp D1, the pair of headlamps D2, D3, the right-turn lamp D4, the left-turn lamp D5, and the pair of back lamps D6, D7 communally connected with the sixth magnet YA6, cathodes of the pair of back lamps D6, D7 connected with the seventh magnet YA7, a cathode of the left-turn lamp D5 connected with the eighth magnet YA8, a cathode of the right-turn lamp D4 connected with the ninth magnet YA9, and cathodes of the roof lamp D1, the pair of head lamps D2, D3 respectively connected with the tenth magnet YA10. The first magnet YA1, the second magnet YA2, the third magnet YA3, the fourth magnet YA4 and the fifth magnet YA5 that are arranged on the frame 1, and the sixth magnet YA6, the seventh magnet YA7, the eighth magnet YA8, the ninth magnet YA9 and the tenth magnet YA10 that are arranged on the shell 3 are magnetically fixed with each other accordingly to turn on power supply circuits therebetween. Wherein, the pair of back lamps D6 and D7 is connected with the seventh magnet YA7, and all of the roof lamp D1 and the headlamps D2 and D3 are connected with the tenth magnet YA10, which can save the number of magnets.

The magnetic conductive car model 100 of the present disclosure further includes a main control circuit set on the frame 1, the main control circuit including a plurality of wiring pins m1, m2, m3, m4, m5 electrically connected with the first, second, third, fourth and fifth connecting portions M1, M2, M3, M4, M5, respectively, and a pair of power pins B1, B2 electrically connected with positive and negative poles of the battery 41, respectively. The main control circuit can be an integrated chip, such as a CPU or a single chip microcomputer. The main control circuit can be configured to switch on or off the roof lamp D1, the pair of headlamps D2, D3, the right-turn lamp D4, the left-turn lamp D5, and the pair of back lamps D6, D7. The first connecting portion M1, the second connecting portion M2, the third connecting portion M3, the fourth connecting portion M4 and the fifth connecting portion M5 can be made into a plug-in port for plug-in connection with the wiring pins m1, m2, m3, m4, m5 of the main control circuit, accordingly.

Furthermore, referring to FIG. 8, in an embodiment of the present disclosure, a first resistance R1 is connected between the anode of the roof lamp D1 and the sixth magnet YA6, a second resistance R2 connected between one of the pair of head lamps D2 and the sixth magnet YA6, a third resistance R3 connected between the other of the pair of head lamps D3 and the sixth magnet YA6, a fourth resistance R4 connected between the anode of the right-turn lamp D4 and the sixth magnet YA6, a fifth resistance R5 connected between the anode of the left-turn lamp D5 and the sixth magnet YA6, a sixth resistance R6 connected between one of the pair of back lamps D6 and the sixth magnet YA6, a seventh resistance R7 connected between the other of the pair of back lamps D7 and the sixth magnet YA6. The above resistances R1-R7 are provided to protect the roof lamp D1, the pair of headlamps D2, D3, the right-turn lamp D4, the left-turn lamp D5, and the pair of back lamps D6, D7 from being damaged by high currents.

Figure 2:
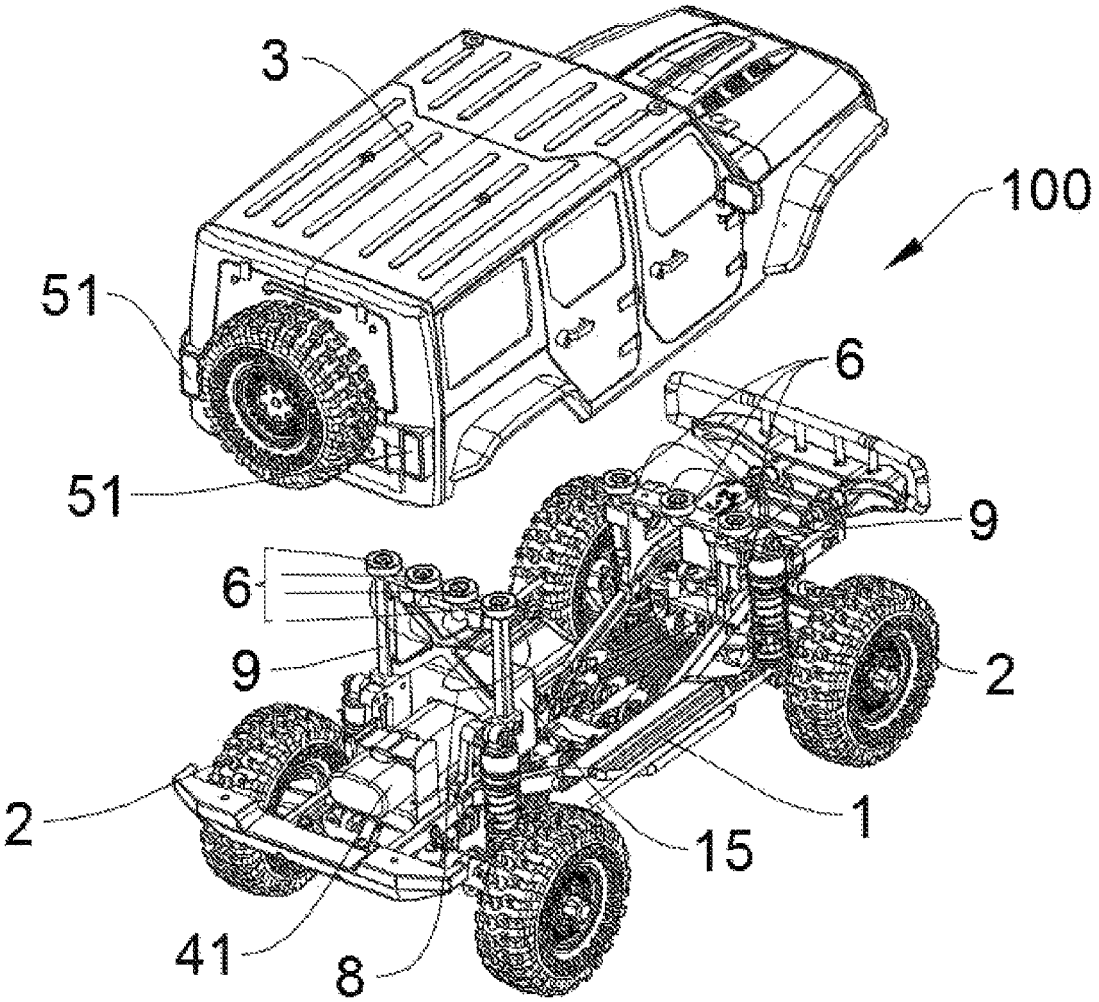
FIG. 2 is a schematic, exploded view of the magnetic conductive car model of FIG. 1.
Figure 3:
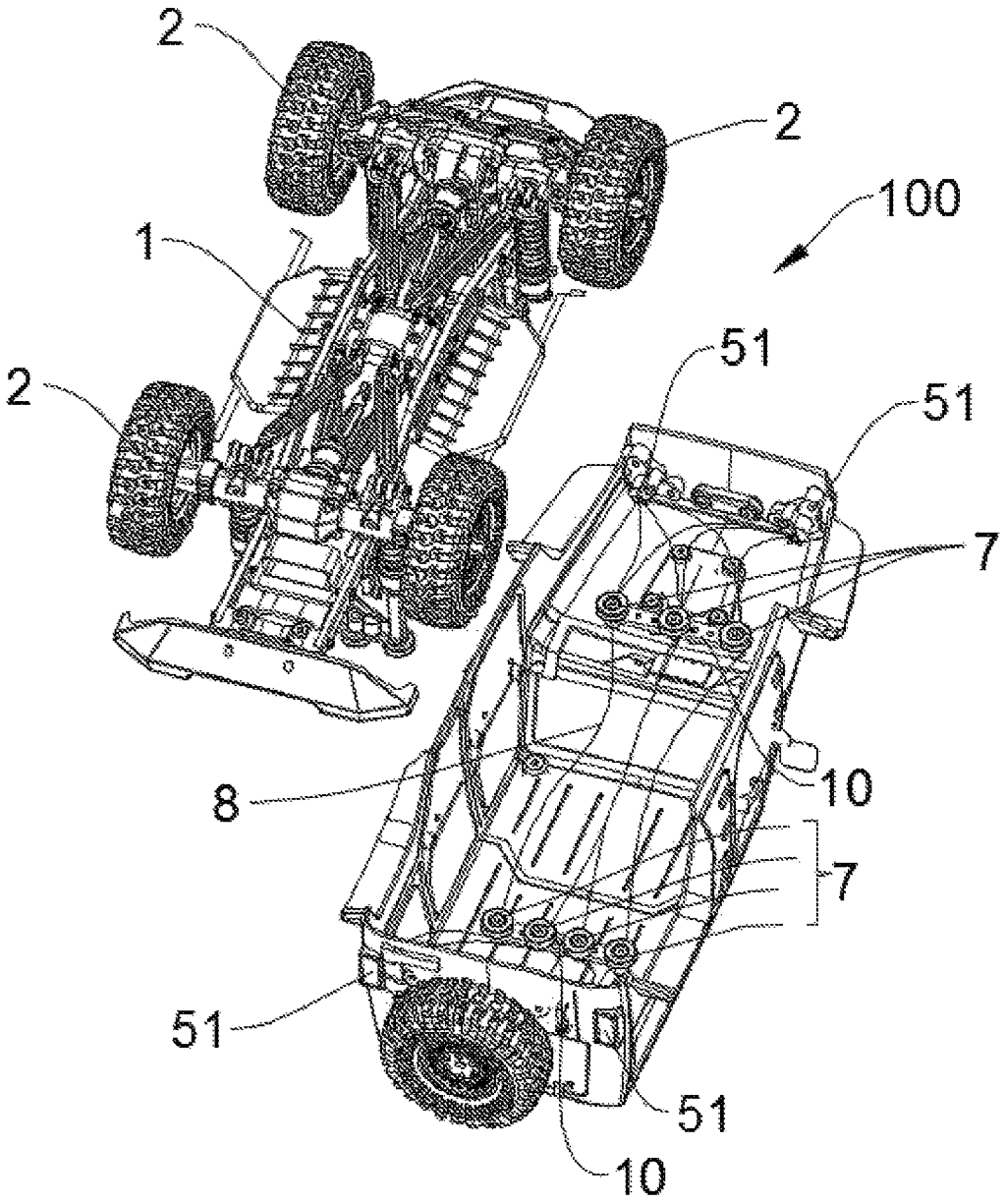
FIG. 3 is similar to FIG. 2, but shown from another view.

Referring to FIG. 2, the car model 100 further includes a drive member 15 arranged on the frame 1. The drive member 15 is configured to drive and control a speed and a steering of the wheels, and can include a drive control circuit, a motor, and a gearbox, etc.

Figure 9:
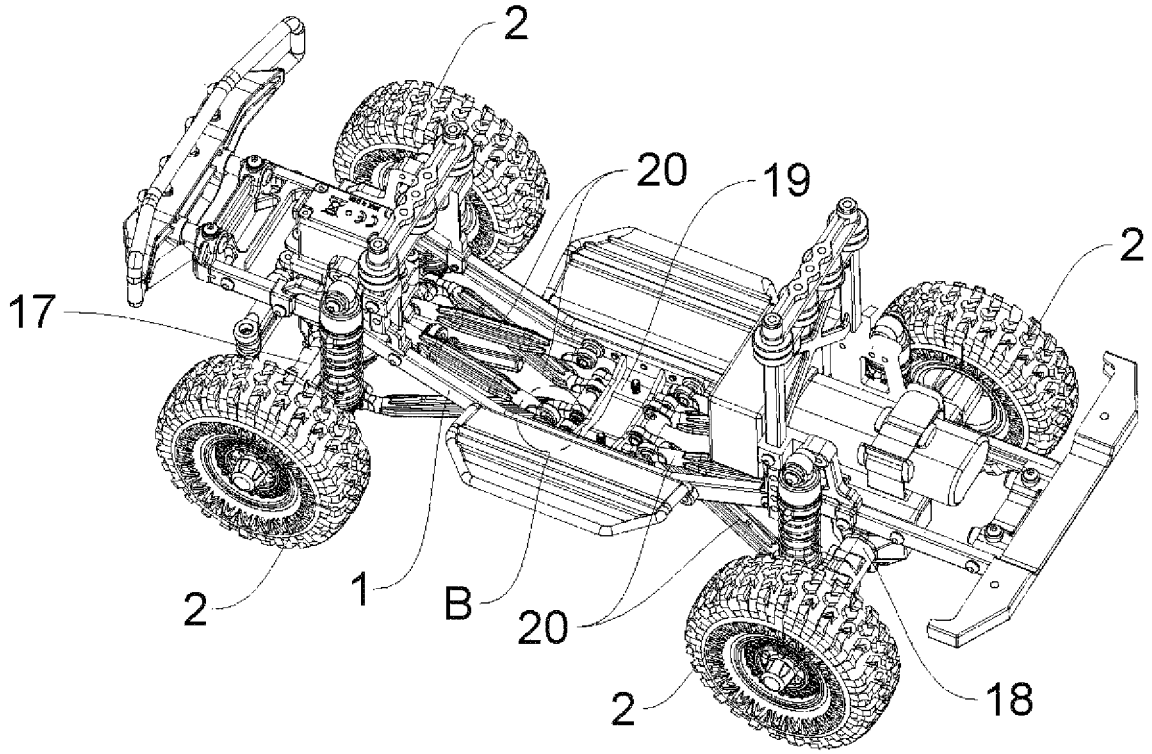
FIG. 9 is a schematic view of a frame of the magnetic conductive car model of FIG. 1.
Figure 10:
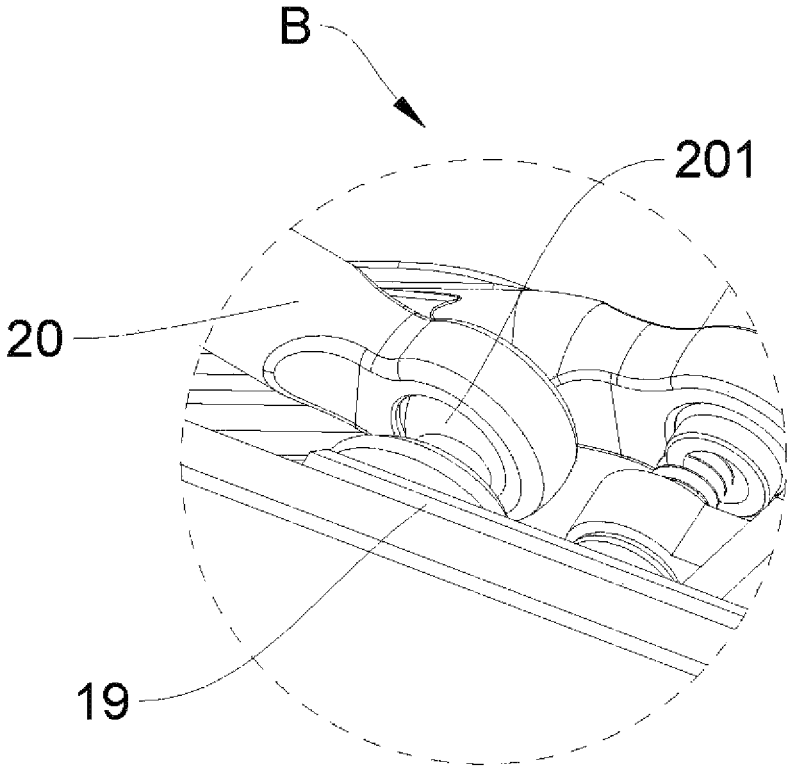
FIG. 10 is an enlarged schematic view of part B of FIG. 9.

Referring to FIG. 9 and FIG. 10, a front axle 17 and a rear axle 18 are respectively arranged on a front end and a rear end of the frame 1, a fixing plate 19 arranged on the middle of the frame 1, and a plurality of ball joint connecting rods 20 respectively connected between the fixing plate 19, and the front axle 17 and the rear axle 18.

The fixing plate 19 is configured to install and fix the gearbox, and joints between the plurality of ball joint connecting rods 20 and the fixing plate 19, the front axle 17 and the rear axle 18 are connected by spherical joints 201. During a climbing process of the car model 100, a torsion angle between the frame 1 and the front axle 17 and the rear axle 18 becomes greater, the ball joint connecting rod 20 is provided that the frame 1 can rotate flexibly relative to the front axle 17 and the rear axle 18 under a large torsion angle, so that the car model 100 can still climb stably. The greater the climbing angle, and the more realistic the simulation performance of the vehicle model 100 is.

Figure 11:
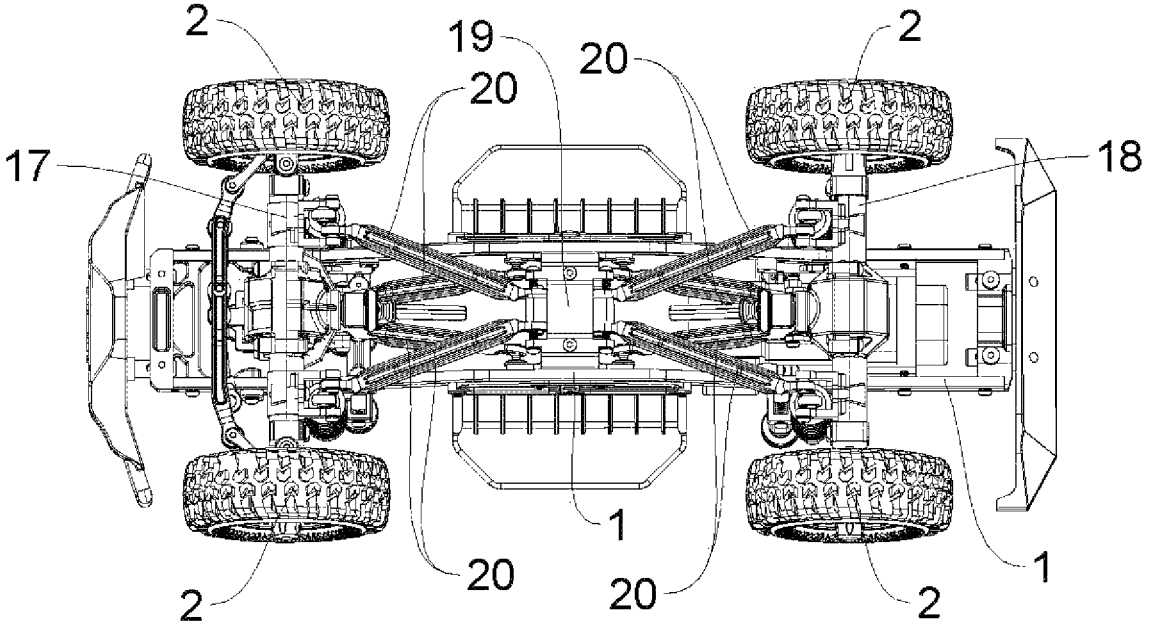
FIG. 11 is a bottom schematic view of the frame of the magnetic conductive car model of FIG. 1.

Furthermore, referring to FIG. 9 and FIG. 11, the plurality of ball joint connecting rods 20 includes a plurality of upper ball joint connecting rod and a plurality of lower ball joint connecting rods arranged below the plurality of upper ball joint connecting rods. That is, the plurality of upper ball joint connecting rods 20 that is arranged between the fixing plate 19 and the front axle 17, so does the plurality of lower ball joint connecting rods 20 that is arranged between the fixing plate 19 and the rear axle 18, in this way, a force between the front axle 17, the rear axle 18 and the frame 1 along upper and lower directions is more balanced, and connections therebetween are more stable.

Furthermore, the plurality of upper ball joint connecting rods 20 is cross arranged with the plurality of lower ball joint connecting rods 20. Referring to FIG. 11, two upper ball joint connecting rods 20 are formed between the front axle 17 and the fixing plate 19, two connection ends of the two upper ball joint connecting rods 20 and the front axle 17 are close to each other, and two opposite connection ends of the two ball joint connecting rods 20 and the fixing plate 19 are separated from each other. Similarly, two lower ball joint connecting rods 20 are formed between the front axle 17 and the fixing plate 19, two connection ends of the two lower ball joint connecting rods 20 and the front axle 17 are separated from each other, and two opposite connection ends of the two lower ball joint connecting rods 20 and the fixing plate 19 are close to each other. In this way, the upper ball joint connecting rods 20 between the front axle 17 and the fixing plate 19, and the lower ball joint connecting rods 20 are intersected with each other on a projection plane thereof, so does the upper and lower ball joint connecting rods 20 between the rear axle 18 and the fixing plate 19. Therefore, a cross arrangement of the upper and lower of ball joint connecting rods 20 is provided that a force between the front axle 17, the rear axle 18 and the frame 1 on a horizontal plane can be more balanced.

Figure 12:
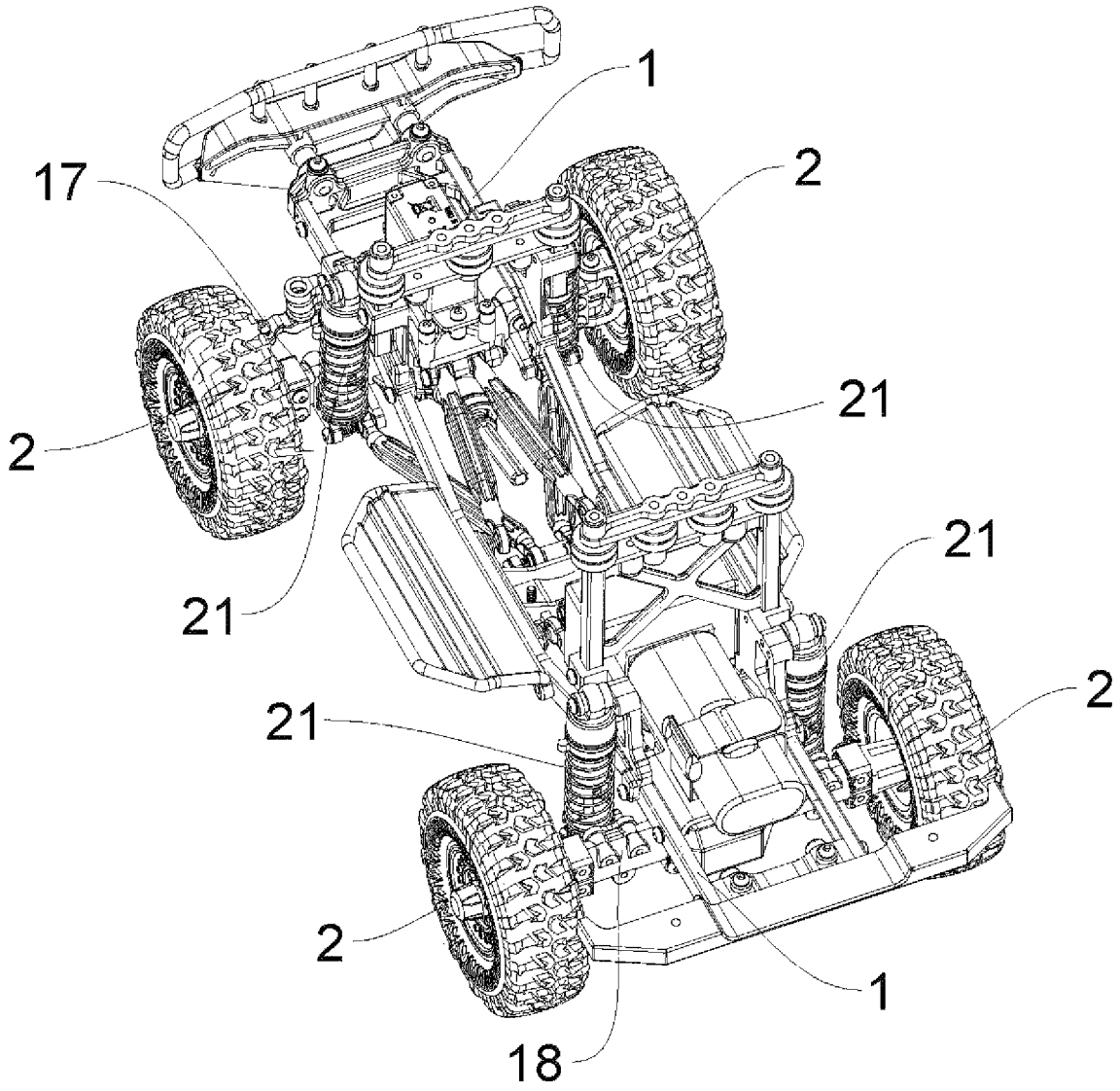
FIG. 12 is an assembly view of the frame and a hydraulic damping member of the magnetic conductive car model of FIG. 1.

Referring to FIG. 12, the car model 100 further includes a plurality of damping mechanisms 21 with a pair of damping mechanisms 21 being connected between left and right sides of the front axle 17 and the frame 1, and a pair of damping mechanisms 21 is connected between left and right sides of the rear axle 18 and the frame 1, which has a better impact resistance effect relative to the conventional car model of the prior art.

Figure 13:
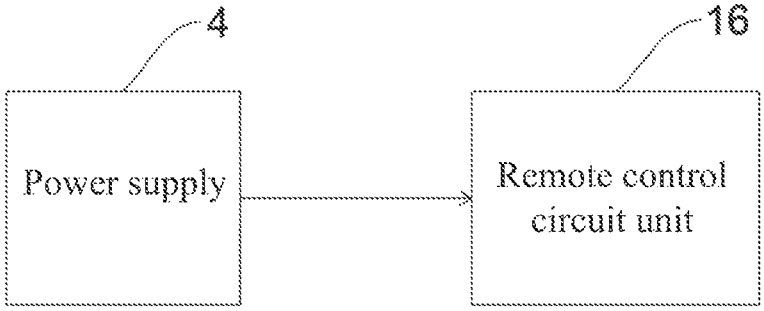
FIG. 13 is a diagram of a remote control circuit unit of the magnetic conductive car model of FIG. 1.

Referring to FIG. 13, the car model 100 further includes a remote control circuit unit 16 received in the frame 1 and configured to receive an external wireless signal, such as a control signal of a remote controller, so as to remotely operate the car model 100 of the present disclosure. The power supply 4 supplies power to the remote control circuit unit 16, and the remote control circuit unit 16 can be equipped with a control chip or connected to the main control circuit of the car model 100 to process remote control signals.

The car model 100 of the present disclosure provides that the first and second magnetic members 6, 7 between the shell 3 and the frame 1 to fix the frame 1 and the shell 3, after the frame 1 is connected with the shell 3 by the magnetic attraction, circuits between the power supply 4 that is arranged on the frame 1 and the power consumption component 5 that is arranged on the shell 3 can be conducted, so that the frame 1 and the shell 3 can be installed and disassembled conveniently and quickly, and form electrical conduction between the circuits at the same time. During disassembly, the frame 1 and the shell 3 can be completely separated from each other, and the circuits can be connected at the same time during installation, which is convenient for the installation and maintenance of the car model, rather than being disturbed by the wires connected between the frame and the shell, and improves use experiences of users.

Although the features and elements of the present disclosure are described as embodiments in particular combinations, each feature or element can be used alone or in other various combinations within the principles of the present disclosure to the full extent indicated by the broad general meaning of the terms in which the appended claims are expressed.

What is claimed is:

1. A magnetic conductive car model comprising:

a frame comprising a first magnetic member arranged thereon;

a plurality of wheels positioned below the frame;

a shell covering the frame and comprising a second magnetic member arranged thereon;

a power supply arranged on the frame and electrically connected with the first magnetic member;

a power consumption component arranged on the shell and electrically connected with the second magnetic member; and wherein the first magnetic member and the second magnetic member are attracted to each other to magnetically fix the frame with the shell, and electrically connect the power supply and the power consumption component; and wherein a pair of first mounting brackets is spaced on an upper end of the frame along a front and rear direction of the frame, and respectively installed with the first magnetic member thereon;

a pair of second mounting brackets arranged on an inner surface of the shell opposite to the pair of first mounting brackets, and respectively installed with the second magnetic member thereon; and wherein the power supply comprises a battery positioned on the frame, and the power consumption component comprises a plurality of lamps positioned on the shell; and wherein the plurality of lamps comprises a plurality of lamp-emitting diodes connected in parallel; and wherein the plurality of lamp-emitting diodes comprises a roof lamp, a pair of headlamps, a right-turn lamp, a left-turn lamp, and a pair of back lamps connected in parallel;

the first magnetic member comprising a first magnet, a second magnet, a third magnet, a fourth magnet and a fifth magnet;

the second magnetic member comprising a sixth magnet, a seventh magnet, an eighth magnet, a ninth magnet and a tenth magnet; and wherein when the frame and the shell are magnetically attached with each other, the first magnet is connected between a first connecting portion and the sixth magnet, the second magnet is connected between a second connecting portion and the seventh magnet, the third magnet is connected between a third connecting portion and the eighth magnet, the fourth magnet is connected between a fourth connecting portion and the ninth magnet, the fifth magnet is connected between a fifth connecting portion and the tenth magnet; and anodes of the roof lamp, the pair of headlamps, the right-turn lamp, the left-turn lamp, and the pair of back lamps are communally connected with the sixth magnet, cathodes of the pair of back lamps are connected with the seventh magnet, a cathode of the left-turn lamp is connected with the eighth magnet, a cathode of the right-turn lamp is connected with the ninth magnet, and cathodes of the roof lamp, and the pair of head lamps are respectively connected with the tenth magnet.

2. The car model as claimed in claim 1, wherein the plurality of magnets are arranged at intervals on each of the first magnetic member and the second magnetic member, each magnet connected with a wire and comprising a mounting hole formed on a middle thereof;

a plurality of screw holes are arranged at intervals on each of the pair of first mounting brackets and the pair of second mounting brackets; and wherein a screw passes through a respective mounting hole of a respective magnet and through a respective screw hole of the first and second mounting brackets to fix the magnets to the first and second mounting brackets.

3. The car model as claimed in claim 1, wherein the shell comprises a plurality of plug holes, a plurality of posts are arranged on the pair of second mounting brackets, to correspondingly insert into the plurality of plug holes of the shell.

4. The car model as claimed in claim 1, wherein each of the pair of first mounting brackets is a portal-frame configuration so that the first magnetic member is positioned on upper portions of the pair of first mounting brackets.

5. The car model as claimed in claim 1, wherein the car model comprises a main control circuit set on the frame, the main control circuit comprising a plurality of wiring pins electrically connected with the first, second, third, fourth and fifth connecting portions, respectively, and a pair of power pins electrically connected with positive and negative poles of the battery, respectively.

6. The car model as claimed in claim 1, wherein a first resistance is connected between the anode of the roof lamp and the sixth magnet, a second resistance connected between one of the pair of head lamps and the sixth magnet, a third resistance connected between the other of the pair of head lamps and the sixth magnet, a fourth resistance connected between the anode of the right-turn lamp and the sixth magnet, a fifth resistance connected between the anode of the left-turn lamp and the sixth magnet, a sixth resistance connected between one of the pair of back lamps and the sixth magnet, a seventh resistance connected between the other of the pair of back lamps and the sixth magnet.

7. The car model as claimed in claim 1, wherein the car model further comprises a drive member arranged on the frame.

8. The car model as claimed in claim 1, wherein a front axle and a rear axle are respectively arranged on a front end and a rear end of the frame, a fixing plate arranged on the middle of the frame, and a plurality of ball joint connecting rods respectively connected between the fixing plate, and the front axle and the rear axle.

9. The car model as claimed in claim 8, wherein the plurality of ball joint connecting rods comprises a plurality of upper ball-joint connecting rods and a plurality of lower ball joint connecting rods arranged below the plurality of upper ball joint connecting rods.

10. The car model as claimed in claim 9, wherein the plurality of upper ball joint connecting rods is cross arranged with the plurality of lower ball joint connecting rods.

11. The car model as claimed in claim 8, wherein the car model further comprises a plurality of damping mechanisms with a pair of damping mechanisms being connected between the frame and the front axle, and a pair of damping mechanisms is connected between the frame and the rear axle.

12. The car model as claimed in claim 1, wherein the car model further comprises a remote control circuit unit received in the frame.

* * * * *